United States Patent [19]

Hall

[11] Patent Number: 4,551,105

[45] Date of Patent: Nov. 5, 1985

[54] MARINE PROPULSION DEVICE WITH TILT AND TRIM MEANS WITH FLUID FILTERING

[75] Inventor: Charles B. Hall, Ingleside, Ill.

[73] Assignee: Outboard Marine Corporation, Waukegan, Ill.

[21] Appl. No.: 562,979

[22] Filed: Dec. 19, 1983

[51] Int. Cl.[4] ..... B63H 5/12

[52] U.S. Cl. ..... 440/61; 91/420; 92/78

[58] Field of Search ..... 440/61; 114/150; 92/78; 91/420, 536

[56] References Cited

U.S. PATENT DOCUMENTS

| | | | |
|---|---|---|---|
| 3,576,192 | 4/1971 | Wood et al. | 91/420 X |
| 3,980,001 | 9/1976 | Cyphelly | 91/420 |
| 4,096,820 | 6/1978 | Hall | 115/41 |
| 4,395,239 | 7/1983 | Hall et al. | 440/61 |
| 4,449,470 | 5/1984 | Rump | 114/150 |

*Primary Examiner*—Sherman D. Basinger

*Attorney, Agent, or Firm*—Michael, Best & Friedrich

[57] ABSTRACT

A marine propulsion device including a member adapted to be connected to a boat hull, and a propulsion assembly pivotally connected to the member for vertical swinging movement when the member is attached to the boat hull. The device also includes a plurality of hydraulic assemblies, each of the hydraulic cylinder assemblies including a hydraulic cylinder and a piston rod slideably received in the cylinder. The hydraulic cylinder assemblies are mounted between the member and the propulsion assembly to effect the vertical swinging movement of the propulsion assembly in response to movement of the piston rods in one direction relative to the cylinders and in the opposite direction relative to the cylinders. The marine propulsion device further includes a reversible pump including a first port and a second port. The marine propulsion device further includes a hydraulic conduit system communicating between the first and second ports and the cylinder assemblies for moving the piston rods in one direction relative to the cylinders in response to pressurization of the first port, and for moving the piston rods in the opposite direction relative to the cylinders in response to pressurization of the second port. The conduit system also includes a filter and a control arrangement communicating with the filter for requiring substantially all of the fluid flowing from the hydraulic cylinder assemblies to the pump to pass through the filter.

17 Claims, 10 Drawing Figures

MARINE PROPULSION DEVICE WITH TILT AND TRIM MEANS WITH FLUID FILTERING

BACKGROUND OF THE INVENTION

The invention relates generally to marine propulsion devices and, more particularly, to outboard motors including propulsion units which are steerable in a horizontal plane and tiltable in a vertical plane.

The invention also relates to hydraulic systems for trimming and power tilting of propulsion units between a lower normal running position in which the propeller is submerged in water and a tilted or raised position in which the propeller is located for above the water assessability. More particularly, the invention relates to means for filtering the fluid used in such hydraulic systems.

Attention is directed to Hall, et al. U.S. Pat. No. 4,395,239, issued July 26, 1983, and Hall U.S. Pat. No. 4,096,820, issued June 27, 1978, which are incorporated herein by reference.

SUMMARY OF THE INVENTION

This invention provides a marine propulsion device including a member adapted to be connected to a boat hull, and a propulsion assembly pivotally connected to the member for vertical swinging movement when the member is attached to the boat hull. The device also includes a plurality of hydraulic assemblies, each of the hydraulic assemblies including a hydraulic cylinder and a piston rod slidably received in the cylinder. The assemblies are mounted between the member and the propulsion assembly to effect the vertical swinging movement of the propulsion assembly in response to movement of the piston rods in one direction relative to the cylinders and in the opposite direction relative to the cylinders.

The marine propulsion device further includes selectively rotatable pump means including first and second ports, the first port being pressurized in response to pump means rotation in one direction, and the second port being pressurized in response to pump means rotation in the other direction. The marine propulsion device further includes conduit means communicating between the first port and the second port and the cylinder assemblies for moving the piston rods in one direction relative to the cylinders in response to pump means rotation in one direction, and for moving the piston rods in the opposite direction relative to the cylinders in response to pump means rotation in the other direction. The conduit means also includes a filter and control means which communicates with the filter for requiring substantially all of the fluid flowing from the cylinder assemblies to the pump means to pass through the filter.

One of the principal features of the invention is the provision of a trim and tilt system for a marine propulsion device which provides for full recirculation through a filter of the hydraulic fluid used in the trim-tilt system to remove contaminates from the the fluid.

Other features and advantages of embodiments of the invention will become apparent upon reviewing the following drawings, the detailed description and the appended claims.

Figure 1:
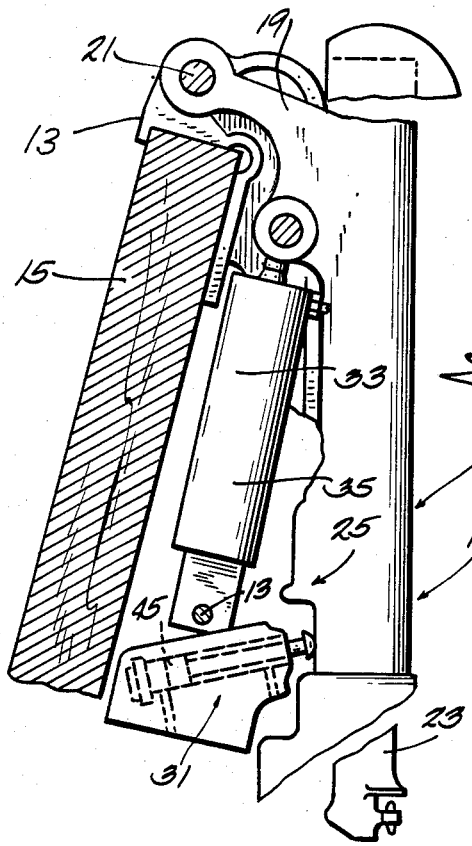
FIG. 1 is a partial schematic side elevation view, partially in section, of a marine propulsion device incorporating various of the features of the invention.

Before explaining some embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF PREFERRED EMBODIMENTS

Figure 2:
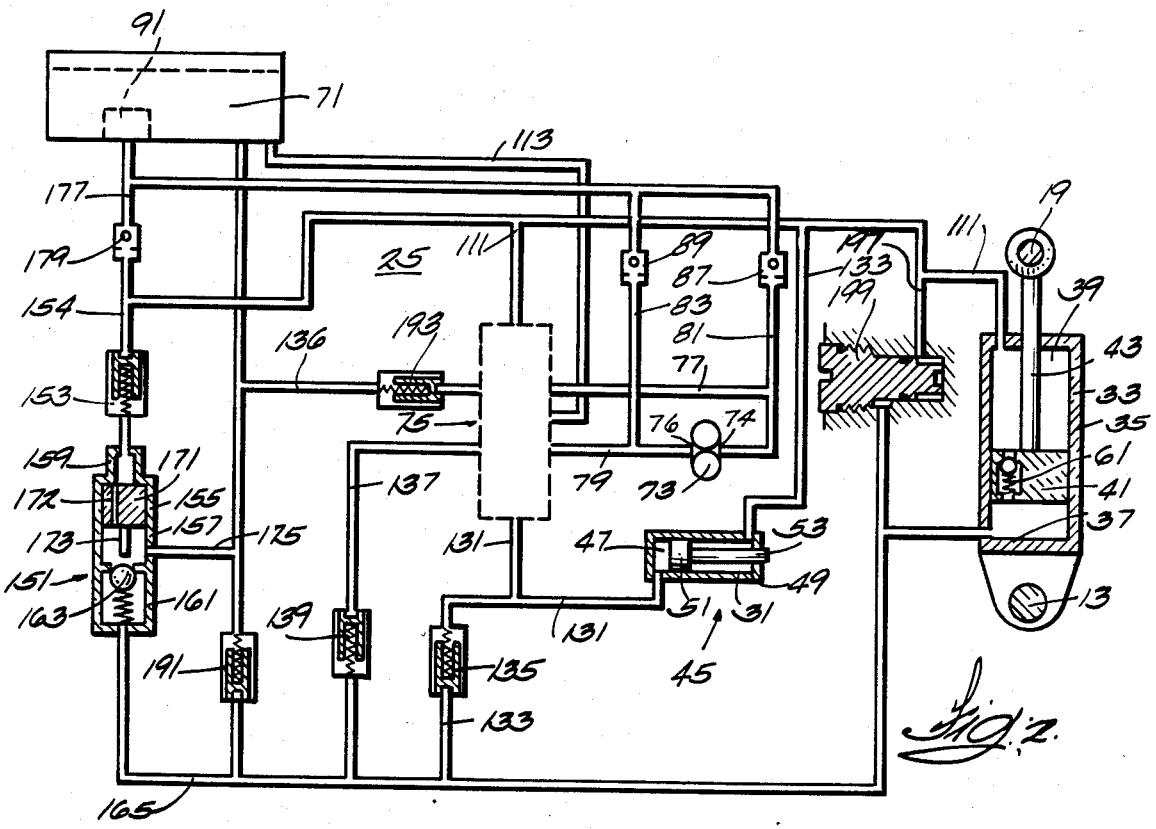
FIG. 2 is a schematic diagram of the hydraulic system incorporated in the marine propulsion device shown in FIG. 1.

Shown in FIGS. 1 and 2 is a marine propulsion device which is shown schematically in the form of an outboard motor 11 including a member 13 adapted to be suitably attached to a boat hull 15, and a propulsion assembly 17 connected to the member 13 for vertical swinging movement between a fully lowered position and a fully raised position when the member 13 is connected to the boat hull 15. Any suitable form of propulsion assembly can be employed, including, for instance, a swivel bracket 19 connected to the member 13 about a horizontal tilt pin 21, and a propulsion unit 23 connected to the swivel bracket 19 for steering movement relative thereto. The invention is equally applicable to stern drive units and to outboard motors.

Connected between the member 13 and the propulsion assembly 17 is (See FIG. 2) a hydraulic system 25 for tilting and trimming the propulsion assembly 17 relative to the boat mounted member 13. As used herein, "trimming" refers to angular adjustment or movement within a trim range extending up and from the fully lowered position of the propulsion assembly 17, and "tilting" refers to angular adjustment or movement within a tilt range extending upwardly from the top of the trim range to the fully elevated or raised position of the propulsion assembly 17.

The hydraulic system 25 includes one or more trim and tilt hydraulic cylinder-piston assemblies 31 and 33, respectively, which are connected between the member 13 and the propulsion assembly 17. More particularly, the tilt cylinder-piston assembly 33 comprises a tilt cylinder 35 which has opposed first and second ends 37 and 39, respectively, which, at its first end 37, is pivotally connected to one of the member 13 and the propulsion assembly 17, and which contains a tilt piston 41 connected to a piston rod 43 which extends through the second tilt cylinder end 39 and is pivotally connected to the other of the member 13 and the propulsion assembly 17. Preferably, the tilt cylinder-piston assembly 33 is connected between the member 13 and the swivel bracket 19, and the first end 37 of the tilt cylinder 35 is pivotally connected to the member 13 and the piston rod 43 is pivotally connected to the swivel bracket 19.

The trim cylinder-piston assembly 31 comprises a trim cylinder 45 which has opposed first and second ends 47 and 49, respectively, which is fixed to one of the member 13 and the propulsion assembly 17 and which includes a trim piston 51 connected to a piston rod 53 which extends through the second end 49 of the trim cylinder 45, and which is releasably engagable with the other of the member 13 and the propulsion assembly 17. Preferably, the trim cylinder 45 is fixed to the member 13 and the piston rod 53 is releasably engagable with the swivel bracket 19.

Located in the tilt piston 41 is a one-way valve 61 which is in the form of a spring biased ball check valve and which prevents flow from the first end 37 of the tilt cylinder 25 to the second end 39, but which permits flow from the second end 39 of the tilt cylinder 35 to the first end 37 of the tilt cylinder 35 so that, in the event the propulsion assembly 17 impacts an underwater obstacle and the tilt cylinder 35 accordingly extends rapidly, the valve 61 will accomodate flow from the second end 39 of the tilt cylinder 35 through the tilt piston 41 to the first end 37 of the tilt cylinder 35. The bias on the valve 61 is relatively high, for instance, about 2500 lbs/sq.in.

Pressure fluid supply and control means are provided for selectively supplying the trim and tilt cylinder-piston assemblies 31 and 33 with pressure fluid. In the illustrated construction, such means comprises a pump 73 having opposed first and second side ports 74 and 76 which alternately act as inlet and outlet ports depending upon the direction of pump rotation, supply conduits 77 and 79 connected respectively to the first and second ports 74 and 76, and valved fluid conduit means communicating between the supply conduits 77 and 79 and the tilt and trim cylinders 35 and 45, and including control means 75 connected to the pump 73 through the supply conduits 77 and 79. The conduit means also includes a reservoir or sump 71 connected to the pump 73 by the conduits 77 and 79.

The supply conduits 77 and 79 are respectively connected through conduits 81 and 83 with the reservoir 71. In turn, the conduits 81 and 83 include respective one-way valves 87 and 89 permitting flow to the pump 73 and preventing flow to the reservoir 71. The conduits 81 and 83 communicate with the sump or reservoir 71 through a common filter 91 mounted in the reservoir 71.

Figure 7:
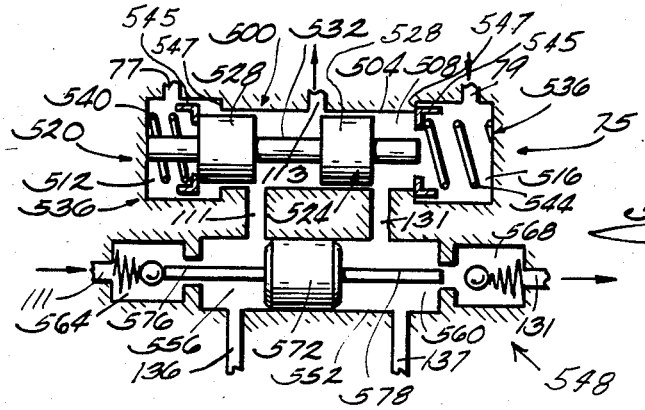
FIG. 7 is a diagrammatic view of control means incorporated in the hydraulic systems shown in FIGS. 2 and 6.
Figure 8:
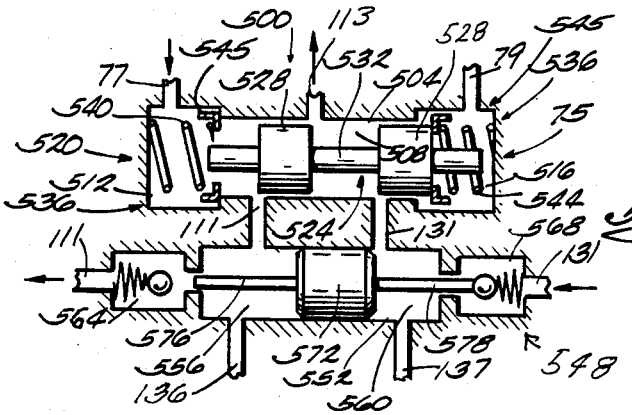
FIG. 8 is another diagrammatic view of the control means shown in FIG. 7, only with a valve piston incorporated therein in a rightmost position.

The control means 75, as illustrated schematically in FIG. 2 and shown more particularly in FIGS. 7 and 8, requires substantially all of the fluid flowing from the hydraulic cylinder assemblies 31 and 33 to the pump 73 to pass through the filter 91. In addition, in the embodiment shown, the control means 75 isolates communication between the pump 73 and the hydraulic assemblies 31 and 33 in the absense of the pump 73 pumping fluid through either the first supply conduit 77, or the second supply conduit 79, as described in more detail hereinafter.

As illustrated in FIG. 2, the control means 75 communicates with the first and second supply conduits 77 and 79, first and second cylinder conduits 111 and 131, first and second control conduits 136 and 137, and a return line 113, as hereinafter described.

The second cylinder conduit 131 also communicates with the first end 37 of the tilt cylinder 35 through a conduit 133 including a normally closed valve 135 which is in the form of a spring biased one-way valve, which prevents flow from the second cylinder conduit 131 to the first end 37 of the tilt cylinder 35, but which releasably prevents or permits flow from the first end 37 of the tilt cylinder 35 to the second cylinder conduit 131.

Also communicating with the first end 37 of the tilt cylinder 35 is the second control conduit 137 which extends from the control means 75 and which includes a normally closed valve 139 which is in the form of a spring biased one-way valve, which prevents flow from the first end 37 of the tilt cylinder 33 to the control means 75, but which releasably prevents or permits flow from the control means 75 to the first end 37 of the tilt cylinder 33 independently of the check valve 135.

The hydraulic system 25 also includes let-down means providing automatic transfer of pressure fluid from the first end 37 of the tilt cylinder 35 to the second end 39 of the tilt cylinder 35 in order to accommodate let-down of the propulsion assembly 17 after the striking of an underwater obstacle. More particularly, there is hydraulically connected between the ends 37 and 39 of the tilt cylinder 35 an automatic let-down assembly 151 which includes an actuating valve 153 which is in the form of a normally closed, spring biased check valve, and which communicates through a conduit 154 with the second end 39 of the tilt cylinder 35 and which is arranged to prevent flow to the second end 39 of the tilt cylinder 35 and to releasably prevent or permit flow from the second end 39 of the tilt cylinder 35 therethrough. The bias on the valve 153 is relatively high, for instance, about 2500 lbs./sq.in.

Also included in the let-down valve assembly 151 is a let-down valve 155 including a housing 157 having a first end 159 communicating with the valve 153, and a second end 161 communicating with a by-pass valve 163 which is in the form of a normally closed, spring biased check valve and which, in turn, communicates through a conduit 165 with the first end 37 of the tilt cylinder 35. The bias on the valve 163 is relatively low, for instance, about 25 lbs./sq.in.

Located within the let-down valve housing 157 is a let-down piston 171 which is movable between a first position adjacent to the first end 159 of the let-down valve housing 157 and a second position spaced from the first position in the direction toward the second end 161 of the let-down valve housing 157. The let-down piston 171 includes a restricted orifice or slot 172 which communicates between the first and second ends of the let-down valve housing 157. In addition, the let-down piston 171 also includes a projection 173 which is operable, upon movement of the piston 171 to the second position, to open the valve 163 so as to permit fluid flow from the first end 37 of the tilt cylinder 35 into the let-down valve housing 157.

Communicating between the second end of the let-down valve housing 157 and the second end 39 of the tilt cylinder 35 is conduit means including a conduit 175 extending from adjacent the second end 161 of the let-down valve housing 157 to the sump 71, and a conduit 177 extending from the sump 71 to the second end 39 of the tilt cylinder 35 and including a one-way valve 179 preventing flow to the sump 71 and permitting flow from the sump 71.

The hydraulic system 25 also includes a normally closed overload valve 191 which communicates between the conduits 165 and 175 and which is in the form of a spring biased valve arranged so as to permit flow from the conduit 165 to the conduit 175 and to prevent flow from the conduit 175 to the conduit 165 and hence from the first end 37 of the tilt cylinder 35 to the sump 71 in the event excess thrust is developed during operation of the propulsion assembly 17. In addition when upward movement of the propulsion assembly 17 is provided, the overload valve 191 prevents overloading of the pump 73 by permitting bypassing of the pressure fluid to the sump 71 whenever movement of the trim piston 51 or tilt piston 41 is blocked, or when the propulsion assembly 17 is in the fully raised position. It is noted that the spring bias on the valve 191 is greater than the spring bias on the valve 139 and greater than the spring bias on the valve 135.

When downward movement of the propulsion assembly 17 is provided, the valve 135 permits return flow from the first end 37 of the tilt cylinder 35 to the control means 75 and back through the return line 113 to the sump 71, as hereinafter described.

The hydraulic system 25 also includes a pressure relief valve 193 which communicates with the sump 71 through the first control conduit 136, which communicates with the control means 75 and which is operative to permit flow from the control means 75 to the sump 71 in the event of excess pressure when providing power operated lowering of the propulsion assembly. In addition, the relief valve 193 also operates, when affording power operated raising of the propulsion assembly 17, to prevent the relatively high pressures resulting from impact or shock absorbtion from adversely affecting the pump 73. The pressure relief valve 193 is preferably in the form of a normally closed, spring biased check valve.

The hydraulic system 25 also includes a conduit 197 which connects the opposed ends 37 and 39 of the tilt cylinder 35, and which includes a manually operable valve 199 permitting bypass of fluid around the tilt piston 41 to accomodate manual raising and lowering of the propulsion assembly 17.

Figure 3:
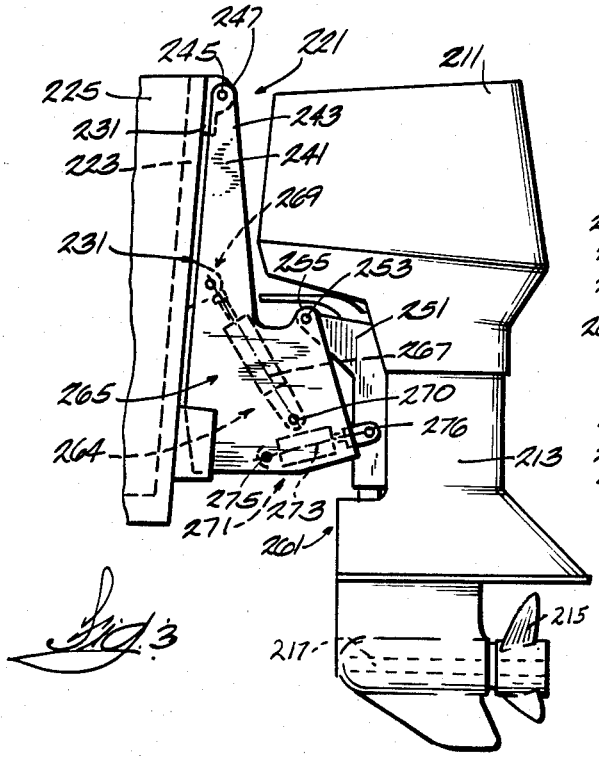
FIG. 3 is a side elevational view of another marine propulsion device incorporating various of the features of the invention.

Shown in FIG. 3 of the drawings is another marine propulsion device in the form of an outboard motor 211 having a generally conventional propulsion unit 213 including, at the lower end thereof, a rotatably mounted propeller 215 driven by a propeller shaft 217. The outboard motor 211 also includes means 221 for pivotally mounting the propulsion unit 213 for pivotal movement in both the horizontal and vertical planes relative to a transom 223 of a boat 225, whereby to provide for steering movement of the propulsion unit 213 in the horizontal plane, and to provide for movement in the vertical plane of the propulsion unit 213 between a lowermost position with the propeller 215 fully submerged in water for driving propulsion, and a raised position affording above-water accessibility to the propeller 215.

The means 221 for pivotally mounting the propulsion unit 213 includes a transom bracket means 231 which can be of unitary construction, or which can comprise several parts, and which is adapted to be fixedly mounted on the transom 223 of the boat 225.

The means 221 for pivotally mounting the propulsion unit 213 also includes a stern bracket 241 having an upper end 243, as well as first or upper pivot means 245 located rearwardly of the boat transom 223, and connecting the upper end 243 of the stern bracket 241 to the transom bracket means 231 for pivotal movement of the stern bracket 241 about a first or upper pivot axis 247 which is horizontal when the transom bracket means 231 is boat mounted. Any means for effecting such pivotal connection can be employed.

The means 221 for pivotally mounting the propulsion unit 213 further includes a swivel bracket 251, together with a lower or second pivot means 253 connecting the swivel bracket 251 to the stern bracket 241 at a point below the first pivot means 245 for pivotal movement of the swivel bracket 251 relative to the stern bracket 241 about a second or lower pivot axis 255 which is parallel to the first or upper pivot axis 247. Any means for effecting such pivotal connection can be employed.

The means 221 for pivotally mounting the propulsion unit 213 further includes means 261 for pivotally connecting the propulsion unit 213 to the swivel bracket 251 for movement in common with the swivel bracket 251 about the first and second or upper and lower pivot axes 247 and 255, and for steering movement of the propulsion unit 213 about a generally vertical axis relative to the swivel bracket 251. any suitable means can be provided for pivotally connecting the swivel bracket 251 and the propulsion unit 213, and any suitable means can be employed for effecting steering displacement in a horizontal plane of the propulsion unit 213 relative to the swivel bracket 251.

The outboard motor 211 also includes a hydraulic system 264 for displacing the swivel bracket 251 and connected propulsion unit 213 about the lower horizontal pivot axis 255 and about the upper horizontal pivot axis 247. In the construction illustrated in FIG. 1, the hydraulic system 264 comprises one or more tilt hydraulic cylinder-piston assemblies 265, each having an axis 267 and opposed ends 269 and 270. One end 269 is pivotally connected, by any suitable means, to the transom bracket means 231 and the other end 270 is pivotally connected, by any suitable means, to the stern bracket 241.

Figure 4:
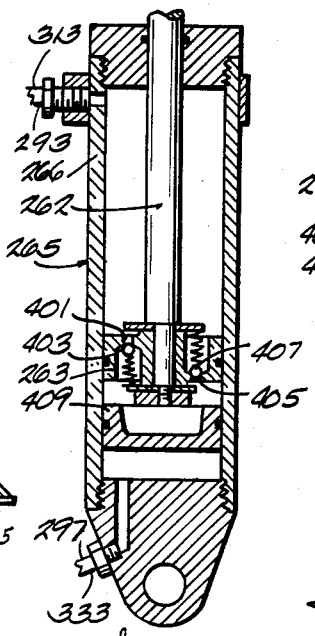
FIG. 4 is an enlarged cross-sectional view of the tilt cylinder-piston assembly incorporated in the marine propulsion device shown in FIG. 3.

While other arrangements could be employed, in the disclosed construction, the tilt cylinder-piston assembly 265 comprises (as shown best in FIG. 4) a tilt piston rod 262 having a first end pivotally connected to one of the stern bracket 241 and the transom bracket means 231, a tilt piston 263 fixed to the other or second end of the tilt piston rod 262, and a tile cylinder 266 receiving the tilt piston 263 and having a first or rod end through which the tilt piston rod 262 passes, and a second or blind end pivotally connected to the other of the stern bracket 241 and the transom bracket means 231. In the disclosed construction, the piston rod is pivotally connected to the transom bracket means 231 and the second or blind end of the cylinder 264 is pivotally connected to the stern bracket 241.

In addition, the hydraulic system 264 for pivotally displacing the swivel bracket 251 and connected propulsion unit 213 includes one or more trim cylinder-piston assemblies, 271, each having an axis 273 and opposed ends 275 and 276. One end 275 is pivotally connected, by any suitable means, to the stern bracket 241, and the other end 276 is pivotally connected, by any suitable means, to the swivel bracket 251.

Figure 5:
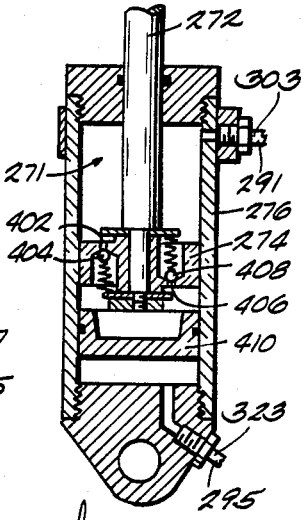
FIG. 5 is an enlarged cross-sectional view of the trim cylinder-piston assembly incorporated in the marine propulsion device shown in FIG. 3.

While other arrangements are possible, in the disclosed construction, the trim cylinder-piston assembly 271 includes (as shown best in FIG. 5) a trim piston rod 272 having a first end pivotally connected to the swivel bracket 251, a trim piston 274 fixed on the other or second end of the trim piston rod 272, and trim cylinder 276 receiving the trim piston and having a first or rod end through which the trim piston rod 272 passes and a second or blind end pivotally connected to the stern bracket 241.

In order to provide for sequential upward pivotal propulsion unit movement through the trim range and then through the tilt range when under thrust conditions, the pivotal connections of the trim cylinder-piston assembly 271 and the tilt cylinder-piston assembly 265 are located such that, when the swivel bracket 251 and connected propulsion unit 213 are in the lowermost position, the ratio of the perpendicular distances from the lower or second pivot axis 255 to the axis of the propeller 215 and to the axis 273 of the trim cylinder-piston assembly 271 is less than the ratio of the perpendicular distances from the upper or first horizontal axis 247 to the axis of the propeller 215 and to the axis 267 of the tilt cylinder-piston assembly 265.

Also included in the hydraulic system 264 for displacing the swivel bracket 251 and connected propulsion unit 213 about the upper and lower horizontal pivot axes 247 and 255, respectively, is (see especially FIG. 6) a source of pressure fluid 281, and a fluid conduit system 283, including a control means 75. The source of pressure fluid 281 includes a reversible electric pump 285 having opposed first and second side ports 287 and 289 which alternatively act as inlet and outlet ports depending upon the direction of pump rotation. The source of pressure fluid 281 also includes a first supply conduit 77 connected to the first side port 287, and a second supply conduit 79 connected to the second side port 289. The first and second supply conduits 77 and 79 communicate through a first duct 294 and second duct 298, respectively, with a reservoir or sump 292. The first duct 294 includes check valve means 296 permitting fluid flow therethrough from the sump 292 to the first side port 287 of the pump 285 and preventing reverse flow, and the second duct 298 includes check valve means 300 permitting fluid flow therethrough from the sump 292 to the other or second side port 289 of the pump 285 and preventing reverse flow. A filter 290 is employed between the sump 292 and the ducts 294 and 298.

The fluid conduit system 283 also connects the source of pressure fluid 281 to the tilt and trim cylinder-piston assemblies 265 and 271, respectively. In this regard, the fluid conduit system 283 includes, in general, first, second, third, fourth and fifth conduit means 291, 293, 295, 297 and 299, respectively.

Figure 6:
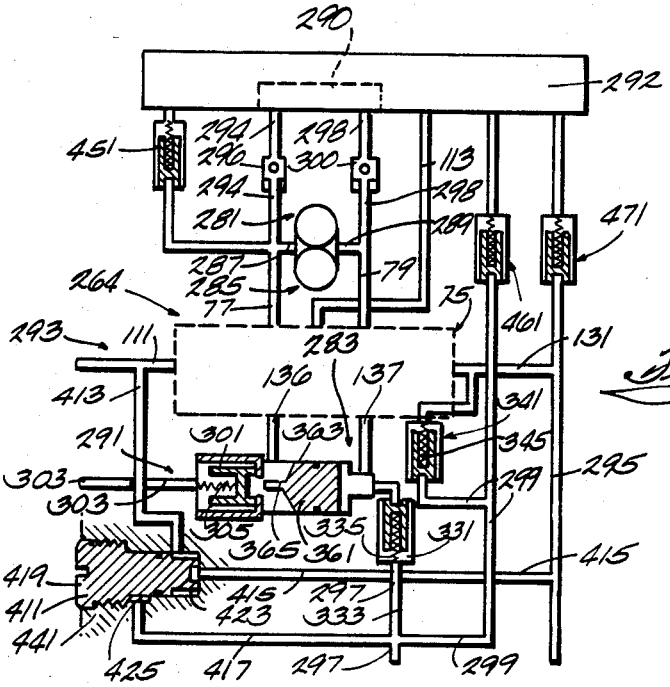
FIG. 6 is a schematic diagram of the hydraulic system incorporated in the marine propulsion device shown in FIG. 3.

The control means 75, as illustrated schematically in FIG. 6 and shown more particularly in FIGS. 7 and 8, requires substantially all of the fluid flowing from the hydraulic cylinder assemblies 265 and 271 to the pump 85 to pass through the filter 290. In addition, in the embodiment shown, the control means 75 isolates communication between the pump 285 and hydraulic assemblies 265 and 271 in the absense of the pump 285 pumping fluid through either the first supply conduit 77, or the second supply conduit 79, as described in more detail hereinafter.

As illustrated in FIG. 6, the control means 75 communicates with the first and second supply conduits 77 and 79, first and second control conduits 136 and 137, first and second cylinder conduits 111 and 131, and a return line 113, as hereinafter described. The control means 75 and above named conduits bear the same numerical designations as comparable components of the first embodiment 11.

The first conduit means 291 includes first check valve means 301 dividing the first conduit means 291 into the first control conduit 136 communicating with the control means 75, and a downstream portion 303 communicating with the first or rod end of the trim cylinder-piston 271, which first check valve means 301 is yieldably biased by a spring 305 to the closed position, and is operative to permit flow from the upstream portion to the downstream portion 303 in response to the presence of fluid under pressure at the first pump port 287, and to permit flow from the downstream portion 303 to the upstream portion in response to the presence of fluid under pressure at the second pump port 289.

The second conduit means 293 is divided by the control means 75 into the first supply conduit 77 communicating with the first pump port 287 and the first cylinder conduit 111 communicating with the first or rod end of the tilt cylinder-piston assembly 265.

The third conduit means 295 is divided by the control means 75 into the second supply conduit 79 communicating with the second pump port 289, and the second cylinder conduit 131 communicating with the second or blind end of the trim cylinder-piston assembly 271.

The fourth conduit means 297 includes fourth check valve means 331 dividing the fourth conduit means 297 into the second control conduit 137 communicating with the control means 75, and a downstream portion 333 communicating with the second or blind end of the tilt cylinder-piston assembly 265, which fourth check valve means 331 is yieldably biased by a spring 335 to the closed position, and is operative to permit flow from the upstream portion to the downstream portion 331 in response to the presence of fluid under pressure at the second pump port 289.

The fifth conduit means 299 includes fifth combined check and pressure relief valve means 341 communicating between the second cylinder conduit 131 and the downstream portion 333 of the fourth conduit means 297, which fifth check valve means 341 is biased closed by a spring 345, and is operable to prevent fluid flow from the second cylinder conduit 131 to the downstream portion 333 of the fourth conduit means 297, and to permit fluid flow from the downstream portion 333 of the fourth conduit means 297 to the second cylinder conduit 131 in response to the presence of fluid under pressure at a predetermined level in the downstream portion 333 of the fourth conduit means 297.

Means are also provided for opening the normally closed check valve 301 in the first conduit means 291 in response to pump operation. In this regard, a control piston 361 is located in a control cylinder 363 and, at one end, includes an axially extending pin 365 which, in response to piston movement in the control cylinder 363, is engageable with the normally closed check valve 301 in the first conduit means 291 for opening thereof.

In order to provide for memory after the striking of an underwater obstacle, i.e., in order to have the propulsion unit 213 return to its previously set position, the tilt cylinder-piston assembly 265 and the trim cylinder-piston assembly 271 respectively include floating non-valved pistons 409 and 410 which are respectively located between the blind end of the associated cylinder and the associated piston.

In order to permit upward movement of the propulsion unit 213 in response to the striking of an underwater obstacle, the tilt piston 263 includes therein (see FIG. 6) an orifice 401 and a spring biased check valve 403 which opens in response to substantially increased pressure at the rod end of the tilt cylinder 266 so as to permit flow from the rod end of the tilt cylinder 266 to the area between the fixed piston 263 and the floating piston 409 in tilt cylinder 266 below the piston 263. Such movement of the fluid in the tilt cylinder 266 through the orifice 401 serves to permit extension of the tilt cylinder-piston assembly 265 and to absorb energy during rapid upward swinging movement of the propulsion unit 213 in response to the striking of an underwater obstacle.

The tilt piston 263 also includes therethrough a second orifice 405 and a spring biased valve 407 which serves to yieldably prevent fluid flow from the area between the fixed piston 263 and the floating piston 409 of the tilt cylinder 266 to the rod end of the tilt cylinder 266. Such orifice permits contraction of the tilt cylinder-piston assembly 265 during down movement of the stern bracket 241 and connected propulsion unit 213 subsequent to the striking of an underwater obstacle by permitting return flow of hydraulic fluid from the blind end of the tilt cylinder 264 to the rod end of the tilt cylinder 264, keeping in mind that flow of hydraulic fluid from the blind end of the tilt cylinder 264 through the fourth conduit means 297 is prevented by the check valve 331.

Also in connection with upward movement of the propulsion unit 213 in response to the striking of an underwater obstacle, the trim piston 274 includes therein (see FIG. 5) an orifice 402 and a spring biased check valve 404 which opens in response to substantially increased pressure at the rod end of the trim cylinder 276 so as to permit flow from the rod end of the trim cylinder 276 to the area between the fixed piston 274 and the floating piston 410 of the trim cylinder 276. Such movement of the fluid in the trim cylinder 276 through the orifice 402 serves to permit extension of the trim cylinder-piston assembly 271 and to absorb energy during rapid upward swinging movement of the propulsion unit 213 in response to the striking of an underwater obstacle.

The trim piston 274 also includes therethrough a second orifice 406 and a spring biased valve 408 which serves to yieldably prevent fluid flow from the area between the fixed piston 274 and the floating piston 410 of the trim cylinder 276 to the rod end of the trim cylinder 276. Such orifice permits contractions of the trim cylinder-piston assembly 265 during down movement of the swivel bracket 251 and connected propulsion unit 213 subsequent to the striking of an underwater obstacle by permitting return flow of hydraulic fluid from the blind end of the trim cylinder 276 to the rod end of the trim cylinder 276, keeping in mind that flow of hydraulic fluid from the blind end of the trim cylinder 276 through the third conduit means 295 is prevented by the pump 285 and control means 75, as hereinafter described.

The fluid conduit system 283 also includes a manual release valve 411 which allows free travel of the tilt and trim cylinder-piston assemblies 265 and 271. The release valve 411 is sequentially operable to connect the first cylinder conduit 111 of the second conduit means 293 through branch ducts 413 and 415 to the second cylinder conduit 131 of the third conduit means 295, and then to additionally connect the first cylinder conduit 111 of the second conduit means 293 through branch duct 417 with the downstream portion 333 of the fourth conduit means 297, while retaining communication between the second conduit means 293 and the third conduit means 295.

The manual release valve 411 includes a threaded valve member 419 which, in response to rotation thereof, is movable axially in a housing 421 and relative to the adjacent end of the branch duct 415. When in the fully closed position shown in FIG. 6, the end of the valve member 417 closes the branch duct 415 so as to prevent flow between the branch duct 413 and the branch duct 415. However, initial outward valve member movement to the left in FIG. 6 serves to displace the end of the valve member 419 away from the branch duct 415 and thereby to permit fluid flow from the branch duct 413 into an annular space 423 between the end of the valve member 419 and the housing 421, and to the branch duct 415. Further outward retraction toward the left in FIG. 4 of the valve member 419 serves to communicate a passage 425 forming a part of the branch duct 417 and the annular space 423 around the inner end of the valve member 419, thereby communicating the branch duct 417 with the second conduit means 293.

The fluid conduit systems 283 also includes a pressure relief valve 451 which communicates between the first side port 287 of the pump 285 and the sump 293, as well as a pressure relief valve 461 which communicates between the sump 292 and the downstream portion 333 of the fourth conduit means 297. Still further in addition, the fluid conduit system 283 includes a pressure relief valve 471 which communicates between the sump 292 and the downstream portion 323 of the third conduit means 295. The pressure relief valves 451 and 461 are set to relieve pressure at a pressure greater than that of the fifth valve means 341, i.e., at about 1,500 p.s.i. in the disclosed embodiment, and the pressure relief valve 471 is set at a pressure higher than the pressure relief valves 451 and 461, i.e., at about 2,500 p.s.i. in the disclosed embodiment.

As mentioned earlier, in addition to isolation of the hydraulic assemblies 31 or 265 and 33 or 271, when the pump 73 or 285 is not pumping fluid, the control means 75, as illustrated in FIGS. 7 and 8, provides for substantially all of the fluid flowing from the hydraulic cylinder assemblies 31 and 33 or 265 and 271, to the pump 73 to 285, to pass through the filter 91 or 290. In some embodiments, excess pressure relief means may be provided which permits fluid to flow from the hydraulic cylinder assemblies to the pump without passing through the filter. As long as the fluid is filtered during normal operation in the absence of excess pressure, all impurities found in the fluid will be filtered out.

Although the control means 75 has been illustrated in FIGS. 2 and 6 in the two particular hydraulic systems 25 and 264, the control means 75 can be utilized in other marine propulsion devices incorporating trim and tilt hydraulic cylinders.

More particularly, the control means 75 in the hydraulic systems 25 and 264 comprises a return control valve 500 including a valve housing 504 defining a recess 508 including a first end 512 and a second end 516. The first supply conduit 77 is in communication with the first end 512 of the recess 508, and the second supply conduit 79 is in communication with the second end 516 of the recess 508.

The control means 75 also includes the return line 113 which is in communication with the pump 73 or 285 through the sump 71 or 292 and filter 91 or 290 and in communication with the return control valve recess 508 between the first end 512 and the second end 516 thereof. More particularly, as illustrated in FIGS. 2 and 6, the return line 113 is connected to the sump 71 or 292 so that fluid flowing through the return line 113 to the sump 71 or 292 must pass through the filter 91 or 290 before returning to the pump 73 or 285. In other embodiments (not shown), the filter can be located in the return line 113.

As illustrated in FIGS. 7 and 8, the first cylinder conduit 111 is in communication with the recess 508 between the first supply conduit 77 and the return line 113, and the second cylinder conduit 181 is in communication with the recess 508 between the second supply conduit 79 and the return line 113.

The return control valve 500 also includes valve means 520 slidably received in the recess 508 and operable in response to hydraulic pressure at the first end 512 of the recess 508 (as illustrated in FIG. 8) for communicating the first supply conduit 77 with the first cylinder conduit 111 and the second cylinder conduit 131 with the return line 113. The valve means 520 is also operable in response to hydraulic pressure at the second end 516 of the recess 508 (as illustrated in FIG. 7) for communicating the second supply conduit 79 with the second cylinder conduit 131 and the first cylinder conduit 111 with the return line 113.

More particularly, the valve means 520 comprises a valve piston 524 including a pair of piston portions 528 slidably received in the recess 508, means 532 for permitting fluid to pass between the piston portions 528, and means 536 for centering the valve piston 524 between the first end 512 of the recess 508 and the second end 516 of the recess 508 in the absence of hydraulic pressure at the first end 512 and the second end 516 of the recess 508. When the valve piston 524 is centered in the recess 508, th first supply conduit 77 is not in communication with the first cylinder conduit 111, and the second supply conduit 79 is not in communication with the second cylinder conduit 131, and thus serves to isolate the respective cylinder assemblies from the first and second supply conduits 77 and 79 and the pump 73 or 285.

While other constructions can be employed in other embodiments, the means for permitting fluid to pass between the piston portions 528 is in the form of a rod 532 connecting the piston portions 528. The rod 532 has a transverse cross-sectional diameter less than the transverse cross-sectional diameter of the piston portions 528.

The centering means 536 comprises a first spring 540 in the recess 508 and disposed between one of the piston portions 528 and the valve housing 504, and a second spring 544 in the recess 508 and disposed between the other of the piston portions 528 and the valve housing 504. While other constructions can be employed in other embodiments, the centering means 536 also includes plates 545 which are positioned between the piston portions 528, the first and second springs 540 and 544, and ridges 547 in the valve housing 504. The ridges 547 are spaced inwardly from the ends 512 and 516 of the recess 508, and engage the plates 545 when the first and second springs 540 and 544 are fully extended.

As illustrated in FIGS. 2 and 6, each of the hydraulic systems 25 and 264 includes two cylinder assemblies 31 and 33, and 265 and 271, respectively. Each of the hydraulic systems 25 and 264 also include the first cylinder conduit 111 communicating between the control means 75 and one cylinder assembly 33 or 265. The hydraulic systems 25 and 264 also include the cylinder conduit 131 communicating between the control means 75 and the other cylinder assembly 33 or 271.

The control means 75 further includes check valve means 548 in the first and second cylinder conduits 111 and 131 for preventing fluid flow through the first and second cylinder conduits 111 and 131 in the absence of fluid under pressure in the portions of the first and second cylinder conduits 111 and 131 connected to the recess 508.

More particularly, the check valve means 548 comprises a recess 552 in the housing 504 which has opposed first and second ends 556 and 560 which respectively communicate with the first and second control conduits 136 and 137.

Communicating with the first end 556 of the check valve recess 552 is a first spring biased normally closed check valve 564 which also communicates with the first cylinder conduit 111. The first check valve 564 permits the flow of fluid under pressure from the first end 556 of the check valve recess 552 to the first cylinder conduit 111 and releasably prevents reverse fluid flow. Communicating with the second end 560 of the check valve recess 552 is a second spring biased normally closed check valve 568 which also communicates with the second cylinder conduit 131. The second check valve 568 permits fluid under pressure to flow from the second end 560 of the check valve housing 552 to the second cylinder conduit 131 and releasably prevents reverse fluid flow.

The check valve recess 552 includes therein a piston 572 movable from a center position to each of first and second end positions respectively adjacent the first and second ends 556 and 560 of the recess 552 (as illustrated respectively in FIGS. 7 and 8). The check valve piston 572 is movable in response to pressurization of the first end 556 of the recess 552 when the pump 73 or 281 is rotated in one direction, and movable in response to the pressurization of second end 560 of the recess 552 when the pump 73 or 281 is rotated in the other direction.

Means are also provided on the check valve piston 572 in the form of oppositely extending first and second projections 576 and 578 for respectively opening the adjacent check valves when the check valve control piston 572 is located in the first and second end positions. More specifically, as illustrated in FIG. 8, when the first end 556 of the check valve recess 552 is pressurized, the second projection 578 opens the second check valve 568 to permit inflow of fluid from the second cylinder conduit 131 and, as illustrated in FIG. 7, when the second end 560 of the check valve recess 552 is pressurized, the first projection 576 opens the first check valve 564 to permit inflow of fluid from the first cylinder conduit 111.

When the pump 73 or 281 is not operating, the springs in the check valves 564 and 568 close the respective valves and locate the check valve piston 572 in the center position, thereby serving to block the first and second cylinder conduits 111 and 131, as previously described.

Figure 9:
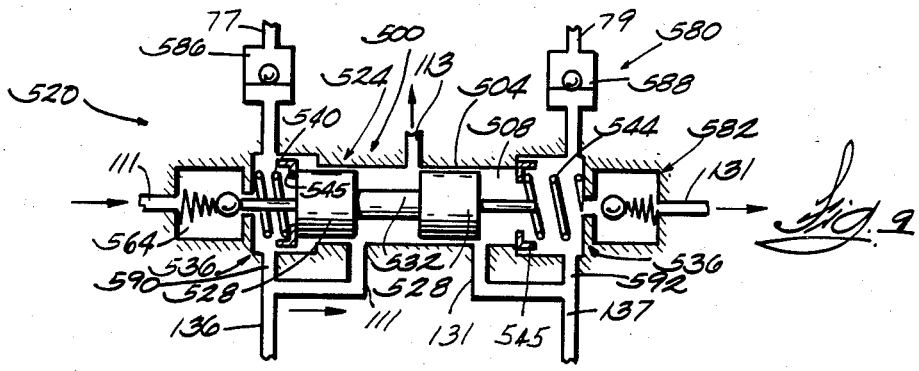
FIG. 9 is a diagrammatic view of another embodiment of the control means shown in FIG. 7.
Figure 10:
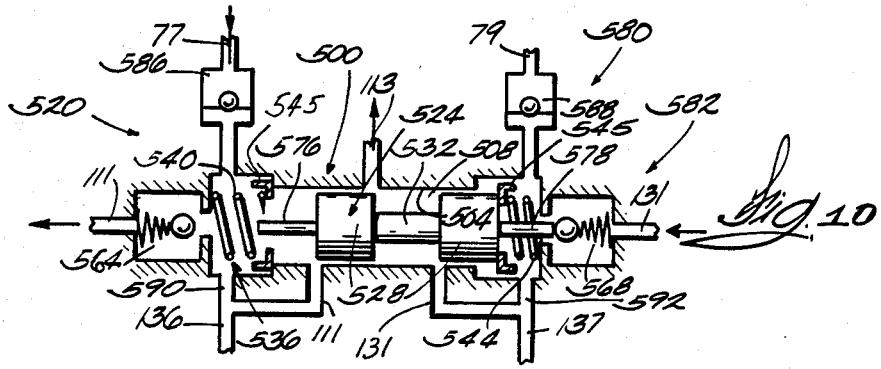
FIG. 10 is another diagrammatic view of the control means shown in FIG. 9, only with a control piston incorporated therein in a rightmost position.

An alternate embodiment 580 of the control means 75 is illustrated in FIGS. 9 and 10. The control means 580 includes many of the same components as the first embodiment 75 of the control means, and like components include the same numerical designation and will not again be described.

The control means 580 includes an alternate embodiment 582 of the check valve means 548. In this embodiment, the return valve recess 508 serves as the check valve recess 552, and the check valves 564 and 568 are respectively located on the first and second ends 512 and 516 of the control valve recess 508. The control valve piston 524 serves as the check valve piston 572 and the projections 576 and 578 extend axially outwardly from the control valve piston portions 528 and open the respective check valves 564 and 568 in the manner previously described.

Since the control valve recess 508 also acts as the check valve recess 552, the first cylinder conduit 111 communicates with the recess 508 both between the first supply conduit 77 and the return line 113 and opposite the first supply conduit 77 by means of a duct 590. Likewise, the second cylinder conduit 131 communicates with the recess 508 both between the return line 113 and the second supply conduit 79 and opposite the second supply conduit 79 by means of a duct 592.

In this embodiment, the first control conduit 136 communicates through the duct 590 with the first end 512 of the control valve recess 508, and the second control conduit 137 communicates through the duct 592 with the second end 516 of the control valve recess 508.

Since the first and second cylinder conduits 111 and 131 communicate with the respective first and second ends 512 and 516 of the control valve recess 508, means are provided in the first and second supply conduits 77 and 79 for preventing fluid returning from the hydraulic cylinder assemblies through the cylinder conduits 111 and 131 from flowing to the pump 73 or 285 through the supply conduits 77 and 79. While other arrangements can be used in other constructions, in this embodiment, such means comprises a one-way check valve 586 in the first supply conduit 77 and a one-way check valve 588 in the second supply conduit 79 for preventing fluid from passing from the control means 580 to the pump 73 or 285 and permitting fluid to flow from the pump 73 or 285 to the control means 580.

Various of the features of the invention are set forth in the following claims.

I claim:

1. A marine propulsion device including a member adapted to be connected to a boat hull, a propulsion assembly pivotally connected to said member for vertical swinging movement when said member is attached to the boat hull, a plurality of hydraulic cylinder assemblies, each of said hydraulic cylinder assemblies including a hydraulic cylinder and a piston rod slidably received in said cylinder, and said hydraulic cylinder assemblies being mounted between said member and said propulsion assembly to effect said vertical swinging movement of said propulsion assembly in response to movement of said piston rods in one direction relative to said cylinders and in the opposite direction relative to said cylinders, selectively rotatable pump means including first and second ports, said first port being pressurized in response to pump means rotation in one direction, and said second port being pressurized in response to pump means rotation in the other direction, and conduit means communicating between said first and second ports and said hydraulic cylinder assemblies for moving said piston rods in one direction relative to said cylinders in response to pump means rotation in one direction, and for moving said piston rods in the opposite direction relative to said cylinders in response to pump means rotation in the other direction, said conduit means also including a filter, and control means communicating with said filter for requiring substantially all of the fluid flowing from said hydraulic cylinder assemblies to said pump means to pass through said filter.

2. A marine propulsion device in accordance with claim 1 wherein said selectively rotatable pump means comprises a reversible pump.

3. A marine propulsion device in accordance with claim 1 wherein said control means includes means for isolating communication between said pump means and said hydraulic cylinder assemblies in the absense of said pump means pressurizing one of said first and second ports.

4. A marine propulsion device in accordance with claim 1 wherein said control means comprises a valve housing defining a recess including a first end and a second end, and wherein said first port is in communication with said first end of said recess through a first supply conduit, and wherein said second port is in communication with said second end of said recess through a second supply conduit, said control means further including a return line in communication with said pump means through said filter, and in communication with said recess between said first end and said second end, a first cylinder conduit in communication with said cylinder assemblies and in communication with said recess between said first supply conduit and said return line, a second cylinder conduit in communication with said cylinder assemblies and in communication with said recess between said second supply conduit and said return line, and valve means slidably received in said recess and operable in response to hydraulic pressure at said first end for communicating said first supply conduit with said first cylinder conduit, and said second cylinder conduit with said return line, and operable in response to hydraulic pressure at said second end for communicating said second supply conduits with said second cylinder conduit, and said first cylinder conduit with said return line.

5. A marine propulsion device in accordance with claim 4 wherein said control means further includes supply means communicating said return line with said pump means, and wherein said filter is mounted in said supply means, and divides said supply means into a portion upstream from said filter and a portion downstream from said filter, and wherein said pump means communicates with said downstream portion of said supply means and wherein said return line communicates with said upstream portion of said supply means.

6. A marine propulsion device in accordance with claim 5 wherein said supply means comprises a fluid reservoir, and said filter is mounted in said reservoir.

7. A marine propulsion device in accordance with claim 4 wherein said valve means comprises a valve piston comprising a pair of piston portions slidably received in said recess, means for permitting fluid to pass between said piston portions, and means for centering said valve piston between said first end of said recess and said second end of said recess in the absence of hydraulic pressure at said first end and said second end of said recess.

8. A marine propulsion device in accordance with claim 7 wherein said valve piston is elongated, and wherein said fluid passing means comprises a rod connecting said piston portions, with a transverse cross-sectional diameter less than the transverse cross-sectional diameter of said piston portions.

9. A marine propulsion device in accordance with claim 7 wherein said centering means comprises a first spring in said recess and disposed between one of said piston portions and said valve housing, and a second spring in said recess and disposed between the other of said piston portions and said valve housing.

10. A marine propulsion device in accordance with claim 4 wherein said control means further includes check valve means in said first and said second cylinder conduits for preventing fluid flow through said first and said second cylinder conduits in the absence of fluid under pressure in one of said ends of said recess.

11. A marine propulsion device in accordance with claim 10 wherein said check valve means comprises a first normally closed check valve in said first cylinder conduit and permitting fluid under pressure to flow from said first end of said recess, a second normally closed check valve in said second cylinder conduit and permitting fluid under pressure to flow from said second end of said recess, and means for opening the other of said check valves in response to fluid under pressure in one of said ends of said recess.

12. A marine propulsion device including a member adapted to be connected to a boat hull, a propulsion assembly pivotally connected to said member for vertical swinging movement when said member is attached to the boat hull, a hydraulic cylinder assembly including a hydraulic cylinder and a piston rod slidably received in said cylinder, said hydraulic cylinder assembly being mounted between said member and said propulsion assembly to effect said vertical swinging movement of said propulsion assembly in response to movement of said piston rod relative to said cylinder, selectively rotatable pump means including first and second ports, said first port being pressurized in response to pump means rotation in one direction, said second port being pressurized in response to pump rotation in the other direction, a filter, control means connected to said hydraulic cylinder assembly for supplying hydraulic fluid thereto and for receiving hydraulic fluid therefrom so as to move said piston rod in one direction relative to said cylinder in response to pump means rotation in one direction, and so as to move said piston rod in the opposite direction relative to said cylinder in response to pump means rotation in the other direction, said control means also being connected to said filter for delivering to said filter substantially all of the hydraulic fluid received by said control means from said hydraulic cylinder assembly, a first supply conduit communicating, in series, between said filter and said first pump port and said control means and including check valve means located between said first pump port and said control means for permitting fluid flow from said first pump port to said control means and for preventing fluid flow from said control means to said first pump port, and a second supply conduit communicating, in series, between said filter and said second pump port and said control means and including check valve means located between said second pump port and said control means for permitting fluid flow from said second pump port to said control means and for preventing fluid flow from said control means to said second pump port.

13. A marine propulsion device including a member adapted to be connected to a boat hull, a propulsion assembly pivotally connected to said member for vertical swinging movement when said member is attached to the boat hull, a hydraulic cylinder assembly including a hydraulic cylinder and a piston rod slidably received in said cylinder, said hydraulic cylinder assembly being mounted between said member and said propulsion assembly to effect said vertical swinging movement of said propulsion assembly in response to movement of said piston rod relative to said cylinder, selectively rotatable pump means including first and second ports, said first port being pressurized in response to pump means rotation in one direction, said second port being pressurized in response to pump means rotation in the other direction, and conduit means communicating between said first and second ports and said hydraulic cylinder assembly for moving said piston rod in one direction relative to said cylinder in response to pump means rotation in one direction, and for moving said piston rod in the opposite direction relative to said cylinder in response to pump means rotation in the other direction, said conduit means also including a filter, and control means communicating with said filter for requiring substantially all of the fluid flowing from said hydraulic cylinder assembly to said pump means to pass though said filter, said control means comprising a valve housing defining a recess including a first end communicating with said first port through a first supply conduit, said recess also having a second end communicating with said second port through a second supply conduit, said control means further including a return line in communication with said pump means through said filter, and in communication with said recess between said first end and said second end, a first cylinder conduit in communication with said cylinder assembly and in communication with said recess through a single port located between said first supply conduit and said return line, a second cylinder conduit in communication with said cylinder assembly and in communication with said recess through a single port located between said second supply conduit and said return line, and valve means slidably received in said recess and operable, in response to hydraulic pressure at said first end for communicating said first supply conduit with said first cylinder conduit and for communicating said second cylinder conduit with said return line, and operable, in response to hydraulic pressure at said second end, for communicating said second supply conduit with said second cylinder conduit and for communicating said first cylinder conduit with said return line.

14. A marine propulsion device including a member adapted to be connected to a boat hull, a propulsion assembly pivotally connected to said member for vertical swinging movement when said member is attached to the boat hull, a hydraulic cylinder assembly including a hydraulic cylinder and a piston rod slidably received in said cylinder, said hydraulic cylinder assembly being mounted between said member and said propulsion assembly to effect said vertical swinging movement of said propulsion assembly in response to movement of said piston rod relative to said cylinder, selectively rotatable pump means including first and second ports, said first port being pressurized in response to pump means rotation in one direction, said second port being pressurized in response to pump means rotation in the other direction, a filter, and valved conduit means communicating between said first and second ports and said hydraulic cylinder assembly for moving said piston rod in one direction relative to said cylinder in response to pump means rotation in one direction, and for moving said piston rod in the opposite direction relative to said cylinder in response to pump means rotation in the other direction, and for requiring substantially all of the fluid flowing from said hydraulic cylinder assembly to said pump means to pass through said filter, said valved conduit means including a valve housing defining a recess including first and second ends, a first supply conduit communicating with said first port and with said first recess end, a second supply conduit communicating with said second port and with said second recess end, a return line in communication with said pump means through said filter and in communication with said recess between said first end and said second end, a first cylinder conduit in communication with said cylinder assembly and in communication with said first recess end and with said recess at a location between said first supply conduit and said return line, first check valve means for releasably preventing flow from said first cylinder conduit to said recess, a second cylinder conduit in communication with said cylinder assembly and in communication with said second recess end and with said recess at a location between said second supply conduit and said return line, second check valve means for releasably preventing flow from second cylinder conduit to said recess, and valve means slidably received in said recess and operable, in response to hydraulic pressure at said first end, for communicating said first supply conduit with said first cylinder conduit and for engaging said second valve means for release thereof to permit flow from said second cylinder conduit to said recess at the location between said second supply conduit and said return line, and operable, in response to hydraulic pressure at said second end of said recess, for communicating said second supply conduit with said second cylinder conduit and for engaging said first valve means for release thereof to permit flow from said first cylinder conduit to said recess at the location between said first supply conduit and said return line.

15. A marine propulsion device in accordance with claim 14 and further including a first bypass conduit communicating through an entry port with said recess at said first end and communicating with said recess at the location between said first supply conduit and said return line, and a second bypass conduit communicating through an entry port with said recess at said second end and communicating with said recess at the location between said second supply conduit and said return line.

16. A marine propulsion device in accordance with claim 15 wherein said piston is dimensioned and said piston movement is limited such that said bypass conduit entry ports remain open at all times.

17. A marine propulsion device including a member adapted to be connected to a boat hull, a propulsion assembly pivotally connected to said member for vertical swinging movement when said member is attached to the boat hull, a hydraulic cylinder assembly including a hydraulic cylinder and a piston rod slidably received in said cylinder, said hydraulic cylinder assembly being mounted between said member and said propulsion assembly to effect said vertical swinging movement of said propulsion assembly in response to movement of said piston rod in one direction relative to said cylinder and in the opposite direction relative to said cylinder, selectively rotatable pump means including first and second ports, said first port being pressurized in response to pump means rotation in one direction, and said second port being pressurized in response to pump means rotation in the other direction, and conduit means communicating between said first and second ports and said hydraulic cylinder assembly for moving said piston rod in one direction relative to said cylinder in response to pump means rotation in one direction, and for moving said piston rod in the opposite direction relative to said cylinder in response to pump means rotation in the other direction, said conduit means also including a filter, and control means communicating with said filter for requiring substantially all of the fluid flowing from said hydraulic cylinder assembly to said pump means to pass through said filter.

* * * * *